United States Patent [19]

Suzuki

[11] Patent Number: 4,760,223

[45] Date of Patent: Jul. 26, 1988

[54] VACUUM CIRCUIT INTERRUPTER

[75] Inventor: Hideo Suzuki, Sagamihara, Japan

[73] Assignee: Kabushiki Kaisha Toshiba, Kawasaki, Japan

[21] Appl. No.: 108,125

[22] Filed: Oct. 14, 1987

[30] Foreign Application Priority Data

Oct. 23, 1986 [JP] Japan ..... 61-250712

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,576,960 | 5/1971 | Kurtz | 200/144 B |
| 3,770,497 | 11/1973 | Hassler et al. | 200/144 B |
| 4,367,382 | 1/1983 | Suzuki et al. | 200/144 B |
| 4,546,222 | 10/1985 | Watanabe | 200/144 B |

FOREIGN PATENT DOCUMENTS 60-243919 12/1985 Japan .

*Primary Examiner*—Robert S. Macon

*Attorney, Agent, or Firm*—Foley & Lardner, Schwartz, Jeffery, Schwaab, Mack, Blumenthal & Evans

[57] ABSTRACT

A circuit interrupter comprising: (a) a pair of electrodes, relatively movable from a position of engagement to a position of disengagement to establish a circuit interrupting arc between the electrodes, at least one of the electrodes having: a contact plate made of low surge material including silver alloy facing the other electrode; a block made of silver, electrically connected to the contact plate and facing the other electrode; and an arc plate of electroconductive material with silver plating, electrically connected to the arc plate and facing the other electrode; and (b) a vessel for enclosing the electrodes and keeping the atmosphere around the electrodes in vacuum.

10 Claims, 2 Drawing Sheets

VACUUM CIRCUIT INTERRUPTER

BACKGROUND OF THE INVENTION

1. Field of the Invention

This invention relates generally to a vacuum circuit interrupter, and more particularly to a structure of a vacuum circuit interrupter of low surge and large current interruption capacity.

2. Description of the Prior Art

In general, high voltage resistance, high fusion-bonding resistance, low surge and large current interrupting capacity are demanded of a vacuum circuit interrupter. These characteristics are highly dependent on the type of materials used for the contact plates of the circuit interrupter. There are no ideal materials for contact plates with which all these characteristics are achieved. Therefore, for most circuit interrupters in which the interrupted current exceeds 4 kA (root mean square), sophisticated means such as addition of spiral electrodes and vertical magnetic field electrodes are employed, as disclosed in U.S. Pat. No. 4,367,382. In such a circuit interrupter, magnetic force generated by the current drives the arc to move around, which prevents local heating of the electrodes.

In recent years, power supply systems have become more complex, and there is an increasing number of situations involving opening and closing of large inductive loads. Therefore, the need for resolving problems of surging is increasing. Harmful surges may be suppressed by adding a surge absorber outside a vacuum circuit interrupter. However, if an outside surge absorber is utilized, the total system of the vacuum circuit interrupter requires a large space for installation, which makes the circuit interrupter bulky and less desirable.

Japanese Patent Disclosure (Kokai) No. 60-243919 shows a low surge vacuum interrupter which includes an electrode having an Ag-WC low surge contact plate. A copper arc plate has a diameter larger than that of the contact plate, and the surface of the copper arc plate is silver plated. A coil is provided at the rear surface of the arc plate. The electrode constitutes a so-called vertical magnetic field electrode structure, in which a magnetic field is imposed parallel to the arc at the time of interruption.

As is well-known, it is important that the arc be dispersed uniformly over the whole surface of the electrodes for interruption of a large current, larger than approximately 10 kA. However, the stabilized arc voltage is about 20 V for contact plates of Ag-WC, while the arc voltage for copper arc plates is about 30 V. Therefore, it is difficult for an arc to move from the contact plate to the copper arc plate. In order to deal with this problem, silver plating was effected over the copper arc plate to facilitate movement of arcs from the contact plate to the copper arc plate, which brought about uniform dispersion of the arc over the whole front surface of the electrode and provided a circuit interrupter with a good interrupting performance.

When a small current, smaller than approximately 10 kA, is interrupted, surge may take place. In this case, however, the arc stays on the low surge contact plate, and local heating on the electrode does not create any problem.

In recent years, there has come to be a demand for improvements of circuit interrupters to provide large current interrupting repetition capacity especially in the regions where short circuiting incidents are frequent.

With the conventional electrode described above, the arc which appears at the time of interruption of large currents travels from the contact plate to the silver plated arc plate and causes scattering and vaporization of the silver plating. Therefore, as the number of times of interruptions increases, the silver on the surface of the copper arc plate is scattered away. It is technically and economically difficult to have thick silver plating on the copper arc plate which endures for a sufficiently long time. When the silver plating has removed from the arc plate, the arc voltage of the arc plate rises to a copper arc voltage level, which makes it difficult for the arc to travel from the contact plate to the copper arc plate. In such a situation the arc is no longer uniformly dispersed.

SUMMARY OF THE INVENTION

An object of this invention is to lengthen the life span of vacuum circuit interrupters of low surge, large current interruption capacity.

According to the invention there is provided a circuit interrupter comprising: (a) a pair of electrodes, relatively movable from a position of engagement to a position of disengagement to establish a circuit interrupting arc between the electrodes, at least one of the electrodes having: a contact means made of low surge material including silver alloy facing to the other electrode; a block made of silver which is electrically connected to the contact means and facing the other electrode; and an arc plate of electroconductive material with silver plating electrically connected to the contact means and facing the other electrode; and (b) means for enclosing the pair of electrodes and keeping the atmosphere around the electrodes in vacuum.

Further objects, features and advantages of the present invention will become apparent from the detailed description of the preferred embodiment that follows, when considered with the attached drawings.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DETAILED DESCRIPTION OF THE PREFERRED EMBODIMENT

Figure 1:
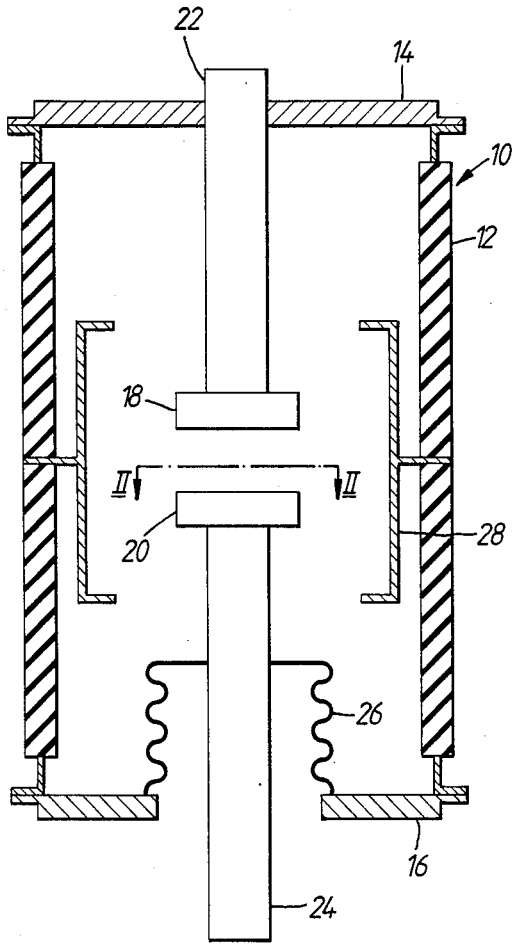
FIG. 1 is a cross-sectional view of an embodiment of this invention.

An embodiment of this invention will now be described referring to FIG. 1. An evacuated vessel 10 has an insulating cylinder 12, and a pair of end plates 14 and 16. The end plates 14 and 16 are tightly sealed to the opposite ends of the cylinder 12. A pair of separable electrodes 18 and 20 are arranged to penetrate the end plates 14 and 16. One electrode 18 is supported by a stationary rod 22 extending through the end plate 14, while the other electrode 20 is connected to a movable rod 24 which extends through the end plate 16 through a bellows 26. An arc shield 28 is provided in the evacuated vessel 10 to surround the electrodes 18 and 20 to prevent metal vapor generated by the electrodes 18 and 20 at the time of separation thereof from depositing on the inner surface of the evacuated vessel 10. An arc takes place between the two electrodes 18 and 20, when they are separated and the current is interrupted.

Figure 2:
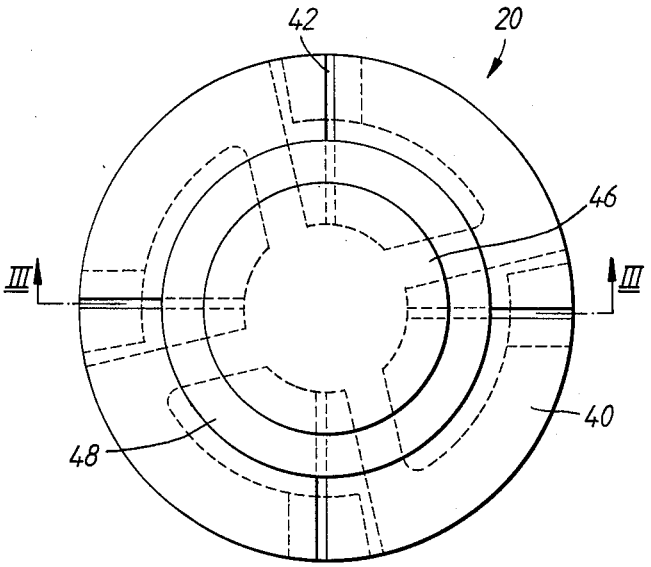
FIG. 2 is a view taken along line II—II of FIG. 1.
Figure 3:
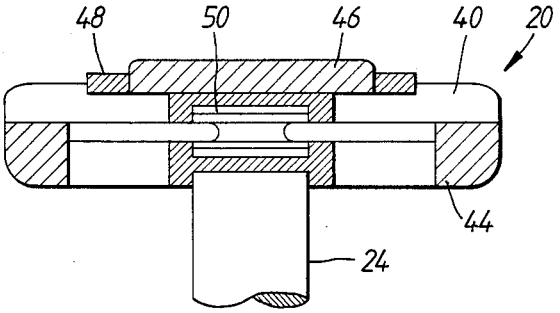
FIG. 3 is a view taken along line III—III of FIG. 2.

The electrodes 18 and 20 have the same construction, and for case of description only, electrode 20 is illustrated in FIGS. 2 and 3 and described hereinbelow. Electrode 20 is of the so-called longitudinal magnetic field electrode construction in which a magnetic field in a direction parallel with the arc is generated as disclosed in U.S. Pat. No. 4,367,382.

The electrode 20 has a circular arc plate 40 which is arranged perpendicular to the direction of the arc. The arc plate 40 is made of electroconductive material such as copper, and has four radial slits 42. A coil member 44 is provided at the rear surface of the arc plate 40. The coil member 44 is made of electroconductive material such as copper, and creates a magnetic field in a direction parallel with the arc. A contact plate 46 is fixed on the center of the arc plate 40. The contact plate 46 is a circular flat plate of a smaller diameter than that of the arc plate 40. The contact plate 46 is made of low surge silver alloy, preferably an Ag-WC sintered alloy. The outer surface of the contact plate 46 projects out from the arc plate 40 toward the other electrode 18.

A ring block 48 made of silver is arranged on the arc plate 40 surrounding and adjacent to the contact plate 46. The outer surface of the ring block 48 projects out from the arc plate 40 toward the other electrode 18. The height of the projection of the ring block 48 is smaller than the contact plate 46.

The arc plate 40 is supported by a reinforcing plate 50 made of nickel or stainless steel. It has high electrical resistance so that it does not affect the intensity of the magnetic field generated, and it prevents deformation or rupture of the arc plate 40 and the coil member 44 which might be caused by mechanical shocks at the time of closing of the circuit interrupter.

With the construction described above, when the current is not interrupted, the projected outer surface of the contact plate 46 of the electrode 20 is in contact with the contact plate of the other electrode 18.

When the electrodes 18 and 20 are separated and large current, larger than approximately 10 kA, is interrupted, an arc first takes place on the contact plate 46. Then the arc easily travels to the silver ring block 48, and then spreads over to the silver plated arc plate 40. Since silver vapor is supplied from the silver ring block 48 on which the arc hits, the scattering of the silver away from the arc plate 40 is suppressed. Silver vapor particles are deposited on the contact plate 46, the ring block 48 and the arc plate 40 after the arc ceases and the silver vapor is cooled. Therefore, the plating of silver on the arc plate 40 is maintained even after many interruptions, and the life span of the circuit interrupter is greatly expanded.

Generally, when large current is interrupted, surge does not takes place.

When small current is interrupted, smaller than approximately 10 kA, a surge may take place. In this case, however, the arc stays on the contact plate 46. Since the contact plate 46 is made of low surge material, the surge does not create any problem. Since the current is small, local heating on the electrode does not create any problem in this case.

The foregoing description has been set forth merely to illustrate a preferred embodiment of the invention and is not intended to be limiting. Since modification of the described embodiment incorporating the spirit and substance of the invention may occur to persons skilled in the art, the scope of the invention should be limited solely with respect to the appended claims and equivalents.

What is claimed is:

1. A circuit interrupter comprising:

(a) a pair of electrodes, relatively movable from a position of engagement to a position of disengagement to establish a circuit interrupting arc between the electrodes, at least one of the electrodes having:

a contact means made of a low surge material including silver alloy, said contact means facing the other electrode;

a block made of silver which is electrically connected to the contact means and facing the other electrode; and an arc plate of electroconductive material having a silver plating surface and electrically connected to the contact means and facing the other electrode; and (b) means for enclosing the pair of electrodes and for maintaining atmosphere around the electrodes in vacuum.

2. A circuit interrupter according to claim 1, wherein the contact means projects out from the arc plate toward the other electrode.

3. A circuit interrupter according to claim 2, wherein the block projects out from the arc plate and the contact means projects out from the block toward the other electrode.

4. A circuit interrupter according to claims 1, 2 or 3, wherein the contact means comprises Ag-WC sintered alloy.

5. A circuit interrupter according to claims 1, 2 or 3, wherein the block is arranged adjacent to the contact means.

6. A circuit interrupter according to claims 1, 2 or 3, wherein the block is arranged adjacent to the silver plating on the arc plate.

7. A circuit interrupter according to claims 1, 2 or 3, wherein the arc plate is made essentially of copper.

8. A circuit interrupter according to claims 1, 2 or 3, wherein the contact means and the block are arranged on the arc plate so that the block surrounds the contact means and the silver plating surface of the arc plate surrounds the block.

9. A circuit interrupter according to claims 1, 2 or 3, wherein the contact means is a flat plate.

10. A circuit interrupter according to claims 1, 2 or 3 when said other electrode includes:

an additional contact means made of a low surge material including silver alloy:

an additional block made of silver which is electrically connected to the additional contact means; and an additional arc plate of electroconductive material having a silver plating surface and electrically connected to the additional contact means.

* * * * *